US011472448B2

(12) United States Patent
Kolshorn et al.

(10) Patent No.: US 11,472,448 B2
(45) Date of Patent: Oct. 18, 2022

(54) COUPLING ARRANGEMENT FOR A RAIL VEHICLE

(71) Applicant: Voith Patent GmbH, Heidenheim (DE)

(72) Inventors: Kay Uwe Kolshorn, Wolfenbüttel (DE); Ralf Schipmann, Neuendorf-Sachsenbande (DE); Erik Johannsen, Braunschweig (DE)

(73) Assignee: Voith Patent GmbH, Heidenheim (DE)

( * ) Notice: Subject to any disclaimer, the term of this patent is extended or adjusted under 35 U.S.C. 154(b) by 407 days.

(21) Appl. No.: 16/447,534

(22) Filed: Jun. 20, 2019

(65) Prior Publication Data

US 2019/0300027 A1 Oct. 3, 2019

Related U.S. Application Data

(63) Continuation of application No. PCT/EP2017/076686, filed on Oct. 19, 2017.

(30) Foreign Application Priority Data

Dec. 21, 2016 (DE) ..... 10 2016 125 087.2

(51) Int. Cl.
*B61G 9/22* (2006.01)
*B61G 7/10* (2006.01)

(52) U.S. Cl.
CPC ..... *B61G 9/22* (2013.01); *B61G 7/10* (2013.01)

(58) Field of Classification Search
CPC ..... B61G 7/10; B61G 9/22
See application file for complete search history.

(56) References Cited

U.S. PATENT DOCUMENTS

| | | | |
|---|---|---|---|
| 7,708,157 | B2 | 5/2010 | Kemper |
| 2007/0107623 | A1 | 5/2007 | Radewagen |
| 2015/0008208 | A1 | 1/2015 | Liu et al. |
| 2015/0114921 | A1 | 4/2015 | Chen et al. |
| 2017/0334468 | A1 | 11/2017 | Chen et al. |

FOREIGN PATENT DOCUMENTS

| | | | | |
|---|---|---|---|---|
| CH | 716600 | A2 * | 3/2021 | ..... F16F 3/0876 |
| DE | 30 15 291 | A1 | 1/1982 | |
| JP | 2012-81934 | A | 4/2012 | |
| WO | 2016/174135 | A1 | 11/2016 | |

OTHER PUBLICATIONS

Notice of Transmission of the International Research Report and the Written Notice Issued the International Searching Authority or Declaration dated Jan. 19, 2018 for International Application No. PCT/EP2017/076686 (13 pages).
German Office Action dated Sep. 11, 2017 for German Application No. 10 2016 125 087.2 (10 pages).

* cited by examiner

*Primary Examiner* — Zachary L Kuhfuss
(74) *Attorney, Agent, or Firm* — Taylor IP, P.C.

(57) ABSTRACT

The invention relates to a coupling arrangement for a rail vehicle that includes a coupling rod which extends along a longitudinal axis, a bearing bracket to which the coupling rod is connected at a second axial end, a bearing between the bearing bracket and the coupling rod, and a support structure which elastically supports the coupling rod in relation to the movement in the vertical direction. The support structure is positioned in the vertical direction at least predominantly level with the bearing bracket and/or with the coupling rod in a manner substantially coaxial with respect to the longitudinal axis.

21 Claims, 4 Drawing Sheets

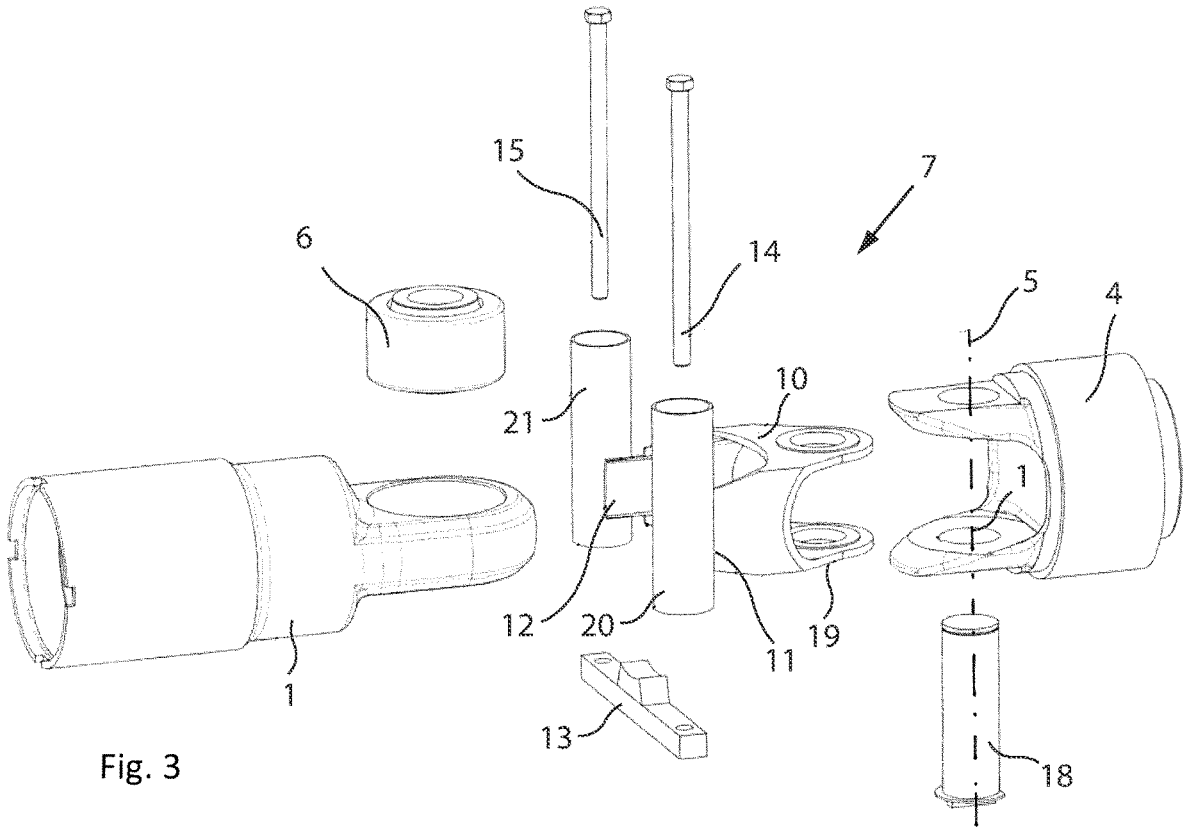
Fig. 3
Fig. 4
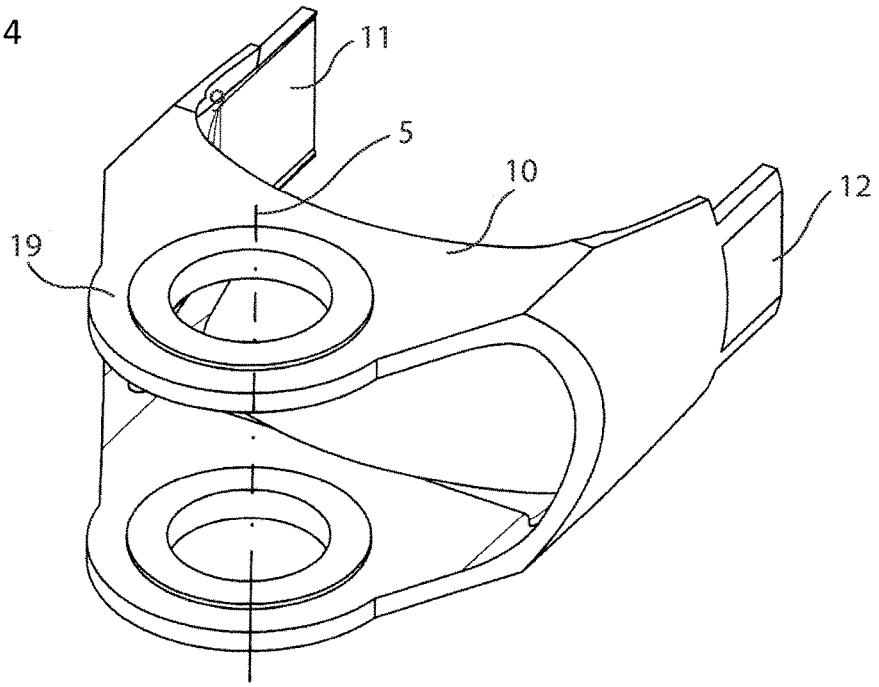

COUPLING ARRANGEMENT FOR A RAIL VEHICLE

CROSS REFERENCE TO RELATED APPLICATIONS

This is a continuation of PCT application No. PCT/EP2017/076686, entitled "COUPLING ARRANGEMENT, IN PARTICULAR FOR A RAIL VEHICLE", filed Oct. 17, 2019, which is incorporated herein by reference.

BACKGROUND OF THE INVENTION

1. Field of the Invention

The present invention relates to a rail vehicle, and in particular to a coupling arrangement for a rail vehicle.

2. Description of the Related Art

A coupling arrangement for a rail vehicle generally includes a coupling rod that supports a coupling head. The coupling rod is typically held by a support structure in a bearing block on the body of the rail vehicle. The support structure may generally include a supporting spring. Hence, the support structure holds the coupling rod at a set height and also allows the coupling rod to move upwardly and downwardly. Generally, a typical support structure is a relatively large structure that is heavy and which occupies a large space outside of the coupling rod. Furthermore, such a support structure may also drastically change the flow of forces through the coupling rod, which may cause damage of the coupling rod.

What is needed in the art is an improved coupling arrangement for a rail vehicle.

SUMMARY OF THE INVENTION

The present invention provides a coupling arrangement which is particularly suitable for a rail vehicle, but can also be used in other vehicles wherein the coupling arrangement serves for example to couple two rail vehicle sections to one another by way of corresponding coupling arrangements or coupling arrangements which interact with one another. The coupling arrangement includes a coupling rod which extends along a longitudinal axis and carries a coupling head in the region of a first axial end.

Moreover, a bearing block is provided to which the coupling rod is connected in an articulated manner about a vertical axis, at a second axial end, which is opposite the first axial end. In an articulated manner about a vertical axis notably means that the connection establishes a mechanically at least substantially rigid coupling in the direction of the longitudinal axis between the coupling rod and the bearing block; potentially, aside from possible resilient deflections.

At the same time, the coupling arrangement also provides a sufficiently great angular deflection of the coupling rod relative to the bearing block and in particular an energy absorbing element adjoining said bearing block and/or relative to a base plate enclosing the bearing block, so that the coupling rod can swivel out laterally when driving through curves.

According to the present invention, a bearing is provided between the bearing block and the coupling rod, wherein the bearing is configured to allow for at least a limited movement between the coupling rod and the bearing block in the vertical direction. In this way, a height compensation can also be achieved. The movement is achieved for example by way of a flexible bearing.

Additionally or alternatively, the bearing block is already movable in the vertical direction.

In addition, a support structure is provided which flexibly supports the coupling rod against the movement in vertical direction, in order to ensure the aforementioned retention of the coupling rod at the correct height.

According to the present invention, the support structure is positioned in the vertical direction, at least predominantly at the height of the bearing block and/or the coupling rod, substantially coaxially relative to the longitudinal axis. This means that the majority of the support structure protrudes in the vertical direction over the coupling rod to only a small extent, for example at most by half or a third of the diameter of the coupling rod. An even tighter fit of the support structure to the coupling rod is possible, so that the support structure protrudes for example only by a quarter of the diameter or less beyond the coupling rod. The explanations above refer to the coupling rod in at least a lateral top view in horizontal direction.

Due to the fact that the coupling rod is positioned at least substantially coaxially relative to the longitudinal axis—which means that the center axis or longitudinal axis of the support structure is arranged close to the longitudinal axis of the coupling rod, extending in particular within the outer circumference of the coupling rod, for example at a minimum distance of half a radius of the coupling rod or less—virtually no additional space is blocked outside the coupling rod by the support structure. The support structure is therefore arranged virtually non-eccentrically relative to the coupling rod. The coupling arrangement does not include, i.e., is in particular free of, a support structure which is carried in an articulated manner exclusively on one side outside the coupling rod in radial direction of the coupling rod. In the current application the term "carried" means any suspension of the relevant component—in this case the support structure—where the weight forces of the component and possibly operational forces acting upon the component are absorbed by the carrier element, for example by the bearing block or by a base plate that is for example fastened to the carriage body.

An additional advantage of a support structure which surrounds the coupling rod advantageously over its circumference is found in a comparatively increased bending resistance moment so that a constant stiffness material can be saved.

It is advantageous if the support structure extends above and below the coupling rod and/or above and below the bearing, that is to say—both in a plane above the coupling rod or of the bearing and a plane below the coupling rod or the bearing. It is self-evident that the support structure herein is generally not only provided with flat components but extends advantageously in a curved manner around the coupling rod.

According to another embodiment of the present invention, the support structure is connected in an articulated manner on the bearing block and is carried by the same. In particular, the support structure is carried exclusively by the bearing block.

It may be advantageous if the support structure is connected to the bearing block in an articulated manner about the same vertical axis as the coupling rod.

The bearing block may be connected advantageously axially to a deformable energy absorbing element which, in particular has a tubular shape.

In particular, a base plate surrounding the bearing block and/or the energy absorbing element is provided, which base plate is configured to connect the coupling arrangement to the carriage body of the rail vehicle or to another vehicle component.

According to one embodiment of the present invention, the support structure is articulated, in particular articulated about the vertical axis, connected to the base plate and is carried by the same, in particular exclusively.

For example, the support structure is connected in an articulated manner to the bearing block and/or the base plate above and below the coupling rod and/or the bearing and is carried by the relevant component.

According to another embodiment of the present invention, the support structure includes a carrier which surrounds the coupling rod over the circumference thereof, and at least two lateral guides connected to the carrier, wherein the lateral guides surround the coupling rod in horizontal direction between them. The lateral guides can be connected with one anther advantageously via a cross member extending below the coupling rod and supporting the coupling rod from below. The lateral guides are for example rigidly connected to the carrier, and the cross member is flexibly connected to the lateral guides, at least in the vertical direction.

According to one embodiment, two columns arranged upright on the cross member are provided which are surrounded around their circumference by the lateral guides and are carried by the lateral guides by way of a spring element.

The bearing may for example be in the embodiment of a spherical bearing.

It may be advantageous if the bearing is designed as a flexible bearing, in particular as a rubber-metal bearing.

In the embodiment including the two lateral guides, a comparatively broad up and down movement of the coupling rod may be facilitated. The two lateral guides moreover contribute advantageously to the high bending resistance moment. However, they contribute at least to a more favorable transmission of force into the structure, in that they positively influence the bending resistance moment in the transition between guides and the carrier of the support structure.

If the lateral guides have a round, in particular cylindrical outer surface and fit more or less tightly against the coupling rod, a comparatively high level of stiffness is achieved also in transverse direction. The stiffness in the transverse direction results in particular from the overall curved shape of the carrier of the support structure, wherein the guides additionally provide the aforementioned influence over the stiffness.

When connecting the support structure to the bearing block, wherein additional connecting points on the base plate are omitted, such a small diameter can be achieved that, in the event of a crash the support structure together with the bearing block and the coupling rod is pushed through the opening in the base plate. Only the lateral guides must be separated from the support structure if—due to their size—they do not fit through the opening. This is achieved for example by shearing off or by way of a suitable plug-in mechanism.

When connecting the support structure to the base plate, in particular above and below the bearing block so that the support structure encompasses the bearing block, the necessary installation space can still be kept small, and an especially high stiffness can be achieved. Due to the fact that two comparatively simple connections of the support structure to the base plate can be provided—because each connection only needs to carry part of the load of the previously additional bearing block—costs are reduced. With this design a lesser tight of the support structure on the coupling rod can be provided, so that in the event of a crash (over load incident) it can be ensured that the coupling rod slides smoothly through the base plate and the support structure. This design permits a comparatively self-contained shape of the support structure that surrounds the coupling rod. Furthermore, it is not necessary that, if later guides are accordingly provided, the guides are separated from the remaining support structure in the event of an overload incident. Instead, a separation between the cross member and the coupling rod can be provided.

An advantage of the present invention is that the support structure may be smaller, weighing less, and thus may occupy a lesser space outside the coupling rod. Another advantage of the present invention is that the support structure changes the flow of forces as little as possible in the event of the occurrence of an overload and hence the support structure advantageously ensures compatibility with the variable energy consumption.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 3 is an exploded view of the embodiment according to FIG. 1;

FIG. 4 is a three-dimensional view of the carrier from the support structure in the embodiment according to FIG. 1;

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 7:
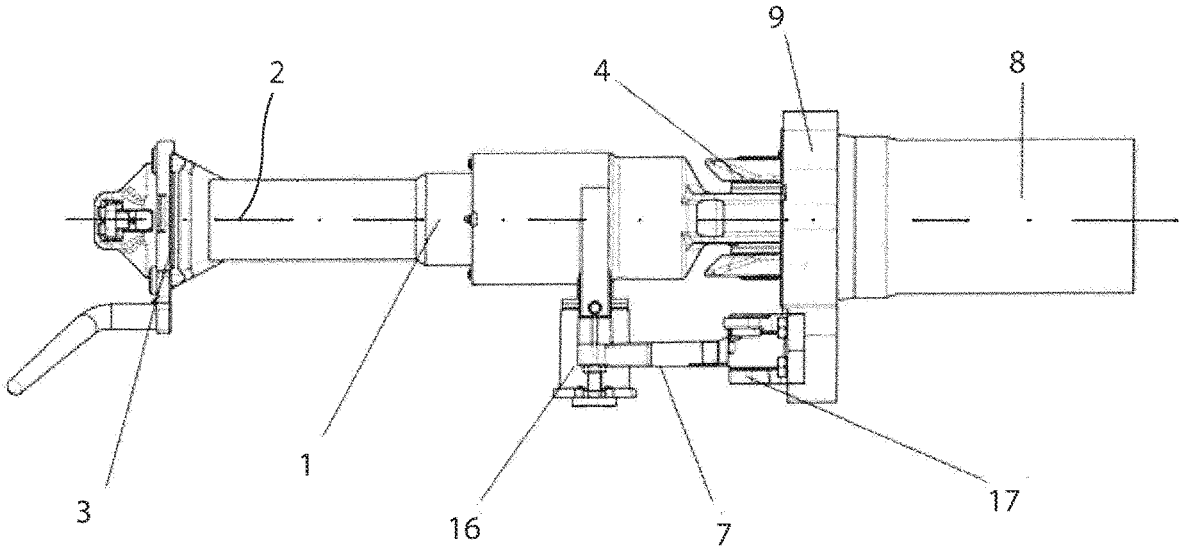
FIG. 7 is a lateral top view of a known coupling arrangement.

Referring now to FIG. 7, there is shown a conventional coupling arrangement for a rail vehicle. With this solution, a coupling rod 1 which extends along a longitudinal axis 2 and which supports a coupling head 3 in the region of a first axial head is held in bearing block 4 on the body of a rail vehicle which is not illustrated. In order to hold coupling rod 1 at a defined height and at the same time to enable the necessary upward and downward movements, a support structure 7 is provided which supports coupling rod 1 from below by way of a supporting spring 16. Due to its pretensioning, supporting spring 16 holds coupling rod 1 at the suitable height and due to its spring reserve, it permits the necessary up and down movement.

An opening for bearing block 4 is provided in base plate 9 which is fastened to the carriage body. This opening is sufficiently large that in the event of an overload in longitudinal direction, in other words in direction of longitudinal axis 2, coupling rod 1 also fits through the opening. Such an overload occurs on impact of the rail vehicle with an obstruction and is also referred to as a crash incident.

Behind the aforementioned opening an energy absorbing element 8 is provided which, in the event of an overload is deformed in longitudinal direction and thus absorbs at least part of the excess force in direction of longitudinal axis 2. During this deformation of energy absorbing element 8, coupling rod 1 can slide at least partially through the opening in base plate 9, and the connection with support structure 7 or more specifically support spring 16 is severed, for example sheared off.

In the illustrated embodiment it is disadvantageous that support structure 7 occupies a comparatively large space below coupling rod 1 and requires an additional bearing block 17, by way of which it is connected in an articulated manner on base plate 9 and is carried by the latter.

Referring now to FIGS. 1-4, there is shown an embodiment of a coupling arrangement according to the present invention. In the present embodiment, the support structure 7 adjoins coupling rod 1 in an especially close manner from the outside. The components of support structure 7 are moreover positioned substantially coaxially relative to coupling rod 1 or to longitudinal axis 2 thereof.

Coupling rod 1 is specifically movably connected to bearing block 4 via spherical bearing 6 (FIG. 3). The movability is achieved through the articulated connection about vertical axis 5 and moreover through the elasticity of bearing 6.

Bearing block 4 has for example a tubular form with an adjoining articulated yoke, and coupling rod 1 has a bearing ring in the region of the second axial end into which bearing 6 is inserted, wherein furthermore a pin 18 is provided which is guided through the articulated yoke an bearing 6 in order to provide the desired rotational mobility about vertical axis 5.

Bearing block 4 is connected to an energy absorbing element 8 which is positioned coaxially relative to coupling rod 1. Bearing block 4 is moreover surrounded by base plate 9 around its outer circumference in such a way that, in the event of a crash incident, bearing block 4 and possibly coupling rod 1 can be pushed in a direction of energy absorbing element 8 through base plate 9.

Support structure 7 is also connected in an articulated manner to bearing block 4, by way of the same vertical axis 5. In this case also by way of pin 18. The support structure 7 includes a support 10 for this purpose which has a basic shape encompassing longitudinal axis 2 and which has an axially adjoining articulated yoke 19 which engages with the articulated yoke of bearing block 4 and which is penetrated accordingly by pin 18. In the region of the axial end opposite articulated yoke 19, carrier 10 includes two lateral guides 11, 12 connected thereto which are equipped with hollow cylinders 20, 21 and which are connected to one another by way of cross member 13 supporting coupling rod 1 from below. The lateral guides 11, 12 are horizontally arranged, substantially perpendicular to the longitudinal axis 2, and flank the or surround the coupling rod 1 therebetween.

Two columns 14, 15, constructed for example by bolts which are surrounded by hollow cylinders 20, 21 and which are flexibly supported relative to hollow cylinders 20, 21 are arranged on cross member 13, so that a flexible raising and lowering of coupling rod 1 relative to carrier 10 is made possible.

Figure 1:
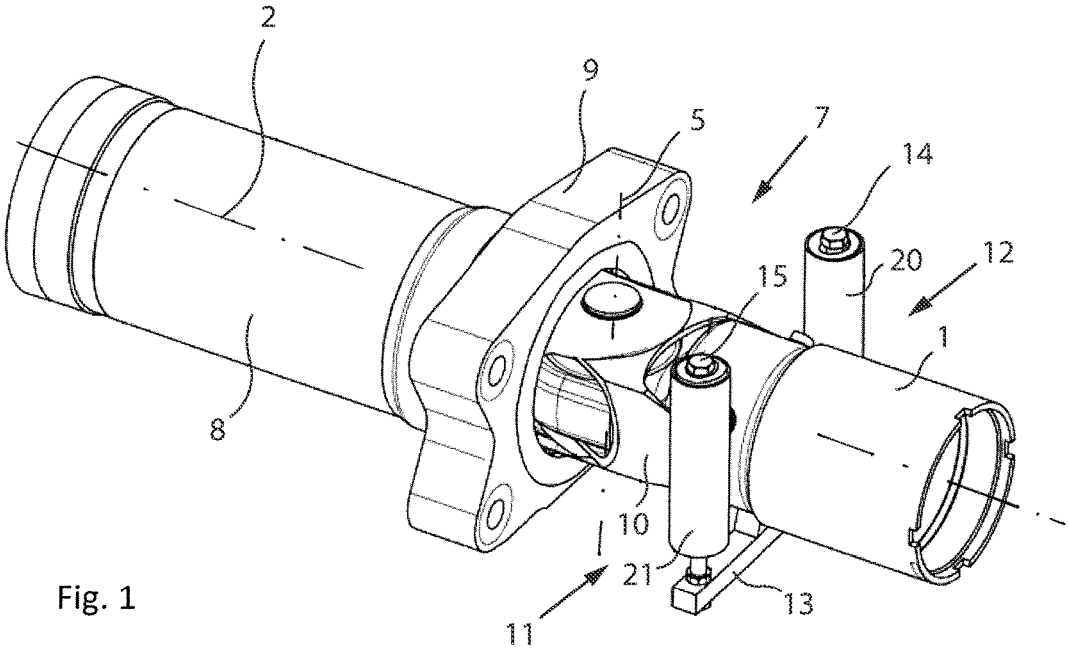
FIG. 1 is a perspective view of embodiment of a coupling arrangement according to the present invention.
Figure 2:
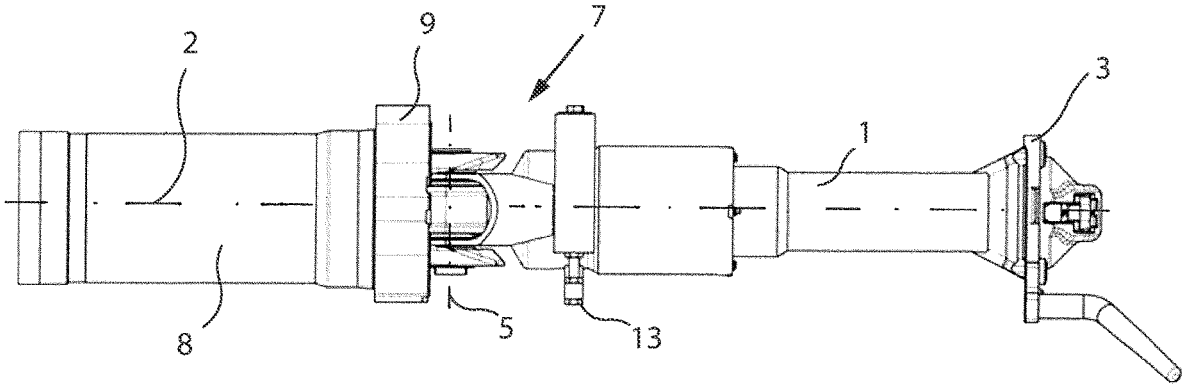
FIG. 2 is a lateral top view onto the embodiment according to FIG. 1.

FIG. 2 moreover illustrates that a coupling head 3 is provided at the first axial end of coupling rod 1.

Figure 5:
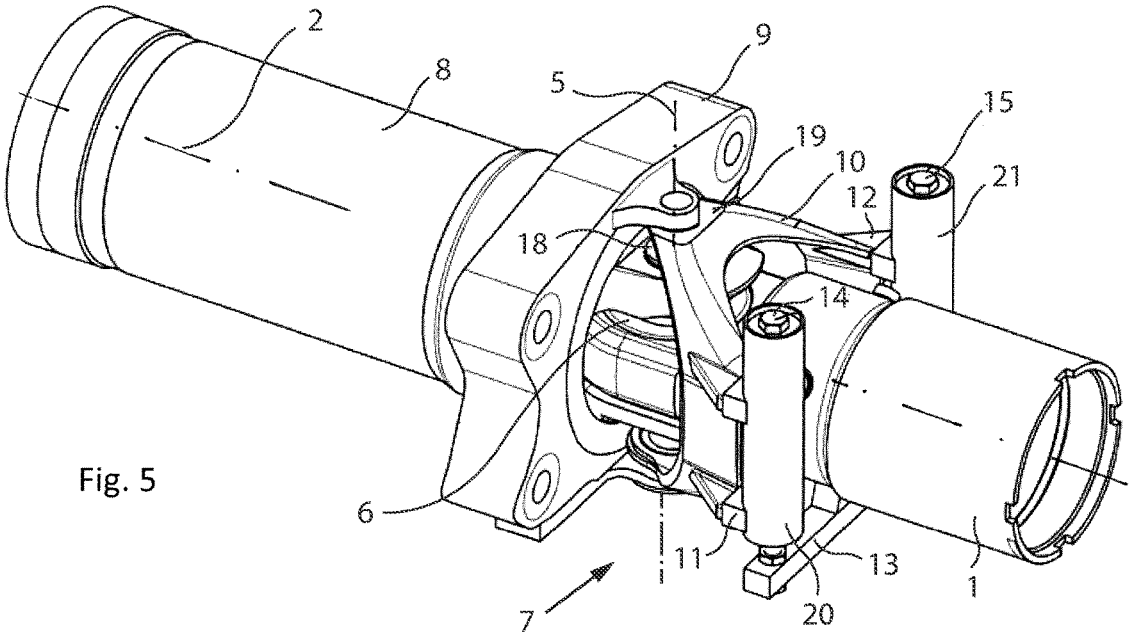
FIG. 5 is a perspective view of another embodiment of a coupling arrangement according to the present invention.
Figure 6:
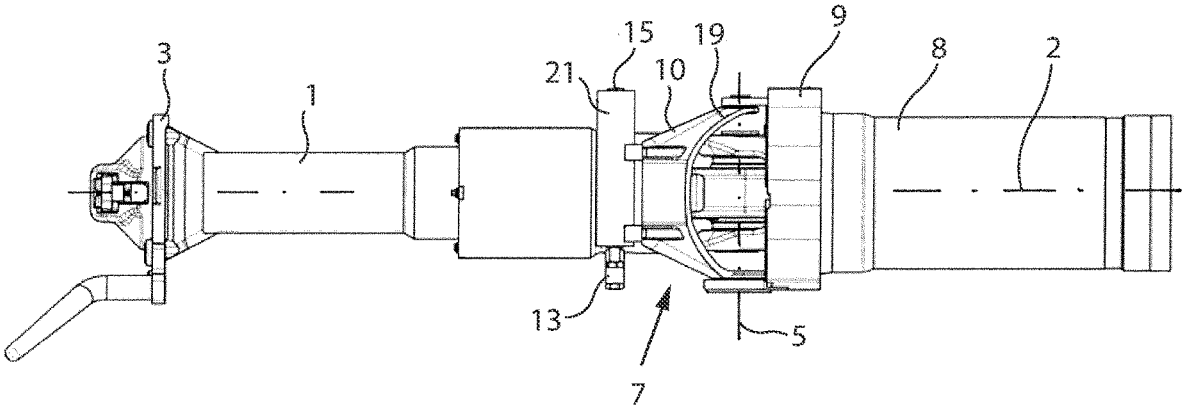
FIG. 6 is a lateral top view onto the embodiment according to FIG. 5.

In the embodiment according to FIGS. 5 and 6 corresponding reference identifications are used for corresponding components. In contrast to the previously discussed embodiment as shown in FIGS. 1-4, carrier 10 in this case is connected to base plate 9 in an articulated manner with articulated yoke 19, outside of the articulated cross member of bearing block 4 above vertical axis 5. This can occur by way of pin 18 or also via special other pins.

In this embodiment, carrier 10 does not fit through the opening in base plate 9, so that in the event of a crash coupling tube 1 is separated from support structure 7, in this case cross bar 13. Accordingly, it is not necessary to separate lateral guides 11, 12 or hollow cylinders 20, 21 from carrier 10.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Coupling rod
2 Longitudinal axis
3 Coupling head
4 Bearing block
5 Vertical axis
6 Bearing
7 Support structure
8 Energy absorbing element
9 Base plate
10 Carrier
11 Lateral guide
12 Lateral guide
13 Cross member
14 Column
15 Column
16 Supporting spring
17 Additional bearing block
18 Pin
19 Articulated yoke
20 Hollow cylinder
21 Hollow cylinder

What is claimed is:

1. A coupling arrangement for a rail vehicle, comprising:

a coupling rod extending along a longitudinal axis and having a first axial end and a second axial end opposite the first axial end;

a coupling head carried by the coupling rod in the region of the first axial end;

a bearing block to which the coupling rod is connected at the second axial end such that the coupling rod is movable about a vertical axis, the bearing block having an articulated yoke;

a bearing positioned between the coupling rod and the bearing block, the coupling rod is configured for permitting at least a limited movement in a vertical direction between the coupling rod and at least one of the bearing block and a bearing block mounting that is movable in the vertical direction; and a support structure that fixedly supports the coupling rod against the movement in the vertical direction, the support structure extends above the bearing block in a vertical direction, and the support structure is positioned substantially coaxially relative to the longitudinal axis, the support structure having a carrier which has an axially connecting articulated yoke that engages in the articulated yoke of the bearing block.

2. The coupling arrangement according to claim 1, wherein the coupling rod has a diameter, the support structure extends to no more than half of the diameter of the coupling rod from the coupling rod.

3. The coupling arrangement according to claim 1, wherein the support structure is connected in an articulated manner on the bearing block and is carried by the bearing block.

4. The coupling arrangement according to claim 3, wherein the support structure is connected to the bearing block in an articulated manner about the vertical axis.

5. The coupling arrangement according to claim 1, further including a deformable energy absorbing element that has a tubular shape, and wherein the bearing block is connected axially to the deformable energy absorbing element.

6. The coupling arrangement according to claim 1, further including at least one of a base plate surrounding the bearing block and a deformable energy absorbing element, wherein the base plate is configured for connecting the coupling arrangement in a supporting manner to a carriage body of the rail vehicle or to another vehicle component.

7. The coupling arrangement according to claim 6, wherein the support structure is connected in an articulated manner about the vertical axis to the base plate and is carried by the base plate.

8. The coupling arrangement according to claim 6, wherein the support structure is connected in an articulated manner to at least one of the bearing block and base plate above and below at least one of the coupling rod and bearing, and the support structure is carried by at least one of the bearing block and base plate.

9. The coupling arrangement according to claim 1, wherein the support structure includes a carrier which surrounds the coupling rod over a circumference thereof.

10. The coupling arrangement according to claim 9, wherein support structure includes at least two lateral guides connected to the carrier, and the lateral guides are horizontally arranged and flank the coupling rod therebetween.

11. The coupling arrangement according to claim 10, wherein the lateral guides are connected with one another via a cross member extending below the coupling rod and supporting the coupling rod from below.

12. The coupling arrangement according to claim 11, wherein the lateral guides are connected rigidly to the carrier, and the cross member is flexibly connected to the lateral guides.

13. The coupling arrangement according to claim 12, further comprising two columns arranged upright on the cross member, and the columns are respectively surrounded and carried by the lateral guides.

14. The coupling arrangement according to claim 1, wherein the bearing is a spherical bearing.

15. The coupling arrangement according to claim 1, wherein the bearing is a flexible bearing in the form of a rubber-metal bearing.

16. The coupling arrangement according to claim 1, wherein the coupling arrangement does not include a support structure which is carried exclusively on one side outside of the coupling rod in an articulated manner on at least one of the bearing block and base plate in a radial direction of the coupling rod.

17. A rail vehicle, comprising:

a coupling arrangement, including:

a coupling rod extending along a longitudinal axis and having a first axial end and a second axial end opposite the first axial end;

a coupling head carried by the coupling rod in the region of the first axial end;

a bearing block to which the coupling rod is connected at the second axial end such that the coupling rod is movable about a vertical axis, the bearing block having an articulated yoke;

a bearing positioned between the coupling rod and the bearing block, the coupling rod is configured for permitting at least a limited movement in a vertical direction between the coupling rod and at least one of the bearing block and a bearing block mounting that is movable in the vertical direction; and a support structure that fixedly supports the coupling rod against the movement in the vertical direction, the support structure extends above the bearing block in a vertical direction, and the support structure is positioned substantially coaxially relative to the longitudinal axis, the support structure having a carrier which has an axially connecting articulated yoke that engages in the articulated yoke of the bearing block.

18. The coupling arrangement according to claim 17, wherein the coupling rod has a diameter, the support structure extends to no more than half of the diameter of the coupling rod from the coupling rod.

19. The rail vehicle according to claim 17, wherein the support structure is connected in an articulated manner on the bearing block and is carried by the bearing block.

20. The rail vehicle according to claim 19, wherein the support structure is connected to the bearing block in an articulated manner about the vertical axis.

21. A coupling arrangement for a rail vehicle, comprising:

a coupling rod extending along a longitudinal axis and having a first axial end and a second axial end opposite the first axial end;

a coupling head carried by the coupling rod in the region of the first axial end;

a bearing block to which the coupling rod is connected at the second axial end such that the coupling rod is movable about a vertical axis;

a bearing positioned between the coupling rod and the bearing block, the coupling rod is configured for permitting at least a limited movement in a vertical direction between the coupling rod and at least one of the bearing block and a bearing block mounting that is movable in the vertical direction;

a support structure that is positioned in the vertical direction at least predominantly at a level of the bearing block and/or the coupling rod substantially coaxially to the longitudinal axis, the support structure being connected in an articulated manner to the bearing block above and below the coupling rod and/or the bearing and the support structure is supported by the bearing, the bearing block having an articulated yoke and the support structure has a carrier which has an axially connecting articulated yoke that engages in the articulated yoke of the bearing block, the carrier having two lateral guides connected in a region of an axial end opposite the articulated yoke of the carrier, the lateral guides enclosing the coupling rod between the lateral guides in a horizontal direction, the lateral guides being connected to one another by a crossmember that runs below the coupling rod, the crossmember supporting the coupling rod from below, the crossmember being connected elastically to the lateral guides in the vertical direction.

* * * * *